US006653538B1

(12) United States Patent
Wells

(10) Patent No.: US 6,653,538 B1
(45) Date of Patent: Nov. 25, 2003

(54) MODULAR CREASED SOUNDBOARD CONSTRUCTION

(76) Inventor: Jeffrey C. Wells, 923 S. 9th St., Salina, KS (US) 67401

( * ) Notice: Subject to any disclaimer, the term of this patent is extended or adjusted under 35 U.S.C. 154(b) by 0 days.

(21) Appl. No.: 10/353,310

(22) Filed: Jan. 29, 2003

(51) Int. Cl.[7] ..... G10D 3/00
(52) U.S. Cl. ..... 84/291; 84/290
(58) Field of Search ..... 84/290, 291, 267, 84/292

(56) References Cited

U.S. PATENT DOCUMENTS 3,722,345 A * 3/1973 Dopera ..... 84/291
4,064,780 A * 12/1977 Bond ..... 84/314 R
4,304,277 A * 12/1981 Petillo ..... 144/350
4,616,548 A 10/1986 Anderson ..... 84/1.16
5,333,527 A 8/1994 Janes et al. ..... 84/291
5,469,769 A * 11/1995 Sawada et al. ..... 84/193
6,037,532 A * 3/2000 Beckmeir ..... 84/293
6,233,825 B1 5/2001 DeGroot ..... 29/896.22
6,255,567 B1 * 7/2001 Minakuchi ..... 84/291

* cited by examiner

*Primary Examiner*—Kimberly Lockett
(74) *Attorney, Agent, or Firm*—Sturm & Fix LLP

(57) ABSTRACT

A modular soundboard construction (10) including a plurality of structural components fabricated from aluminum magnesium and welded together wherein, the components comprise a soundboard panel (20), a floor panel (30), a pair of sidewall panels (40) and (50), and a neck mounting panel (60) wherein, the soundboard panel (20) and floor panel each have a generally flat raised central portion (21) and (31) flanked by angled wing portions (22)(32) and (23)(33) wherein, the transition between the central portion (21)(31) and the winged portions (22)(32) and (23)(33) are defined by straight line creases (24) and (34) which provide a generally oval configuration to the finished soundboard construction (10).

16 Claims, 3 Drawing Sheets

MODULAR CREASED SOUNDBOARD CONSTRUCTION

CROSS REFERENCE TO RELATED APPLICATIONS

This invention was the subject matter of Document Disclosure Program Registration Number 505,082, filed in the United States Patent and Trademark Office on Feb. 7, 2002.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of guitar soundboard construction in general and in particular to a modular creased soundboard construction.

2. Description of Related Art

As can be seen by reference to the following U.S. Pat. Nos. 6,233,825; 6,255,567; 4,616,548; 5,333,527, the prior art is replete with myriad and diverse soundboard constructions for stringed instruments.

While all of the aforementioned prior art constructions are more than adequate for the basic purpose and function for which they have been specifically designed, they are uniformly deficient with respect to their failure to provide a simple, efficient, and practical soundboard using lightweight, long lasting materials in a modular construction that will not chip, rust, or crack while still producing crystal clear tones.

Unfortunately, almost all of the prior art constructions suffer one or more of the following drawbacks: unnecessary weight, need for internal bracing, and relatively short lived structural components.

As a consequence of the foregoing situation, there has existed a long-standing need among musicians for a new and improved lightweight soundboard construction that will last virtually indefinitely with no loss of tonal qualities and the provision of such a construction is a stated objective of the present invention.

BRIEF SUMMARY OF THE INVENTION

Briefly stated, the modular soundboard construction that forms the basis of the present invention comprises in general a stamped modular construction fabricated from a limited number of relatively low cost and abundant aluminum magnesium components including a soundboard panel, a floor panel, a pair of side panels, and a neck mounting plate.

As will be explained in greater detail further on in the specification, while all of the aforementioned components are fabricated from stamped sheets of aluminum magnesium, the neck mounting plate is fabricated from a sheet of aluminum magnesium that is thicker than the rest of the components.

In addition, both the soundboard panel and the floor panel are provided with a pair of diverging creases that will produce a somewhat oval configuration to the finished soundboard body after all of the structural components have been welded together during the fabrication process.

Furthermore, due to the use of aluminum magnesium in all of the structural components, the finished soundboard body will be lightweight, resistant to rust, chipping, cracking, rotting, etc., while still possessing superior longevity over other structural materials plus a crystal clear tone.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
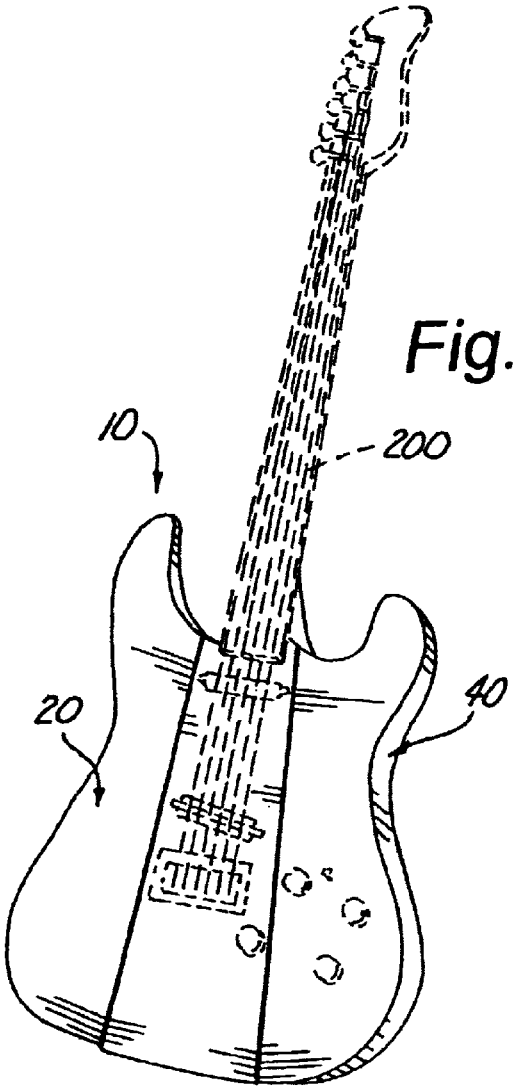
FIG. 1 is a front perspective view of an electric guitar soundboard fabricated in accordance with the teachings of this invention.
Figure 2:
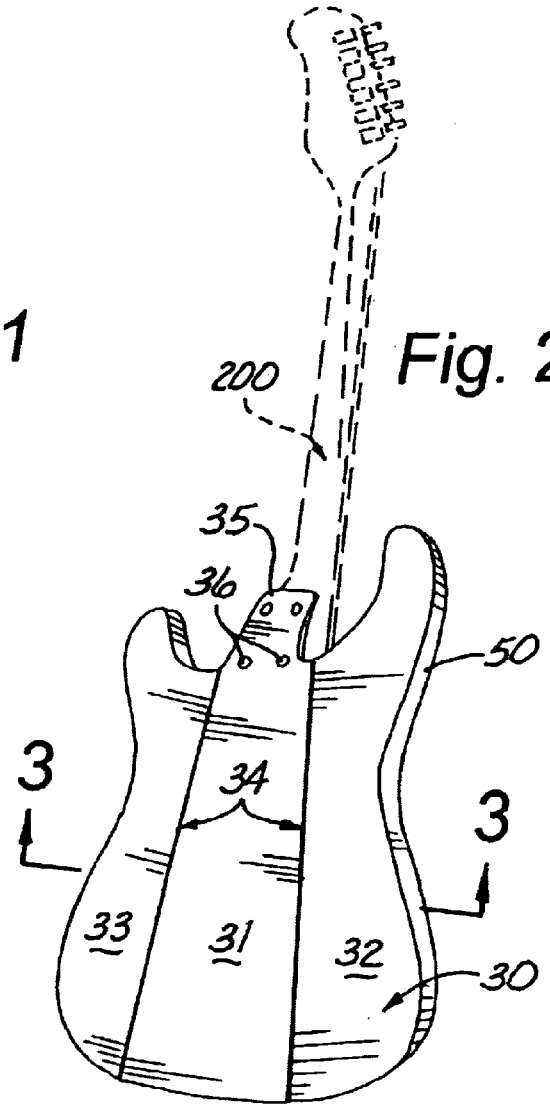
FIG. 2 is a rear perspective view of the soundboard depicted in FIG. 1.
Figure 3:
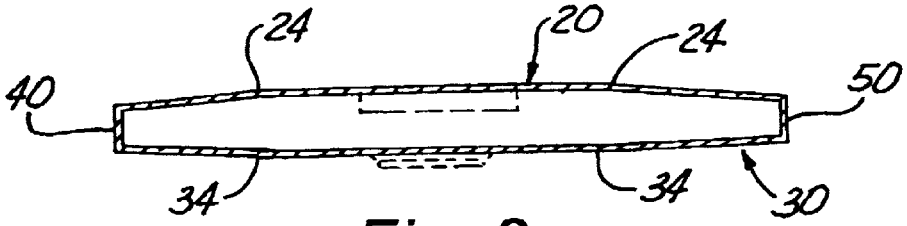
FIG. 3 is a cross sectional view taken through line 3—3 of FIG. 2.
Figure 4:
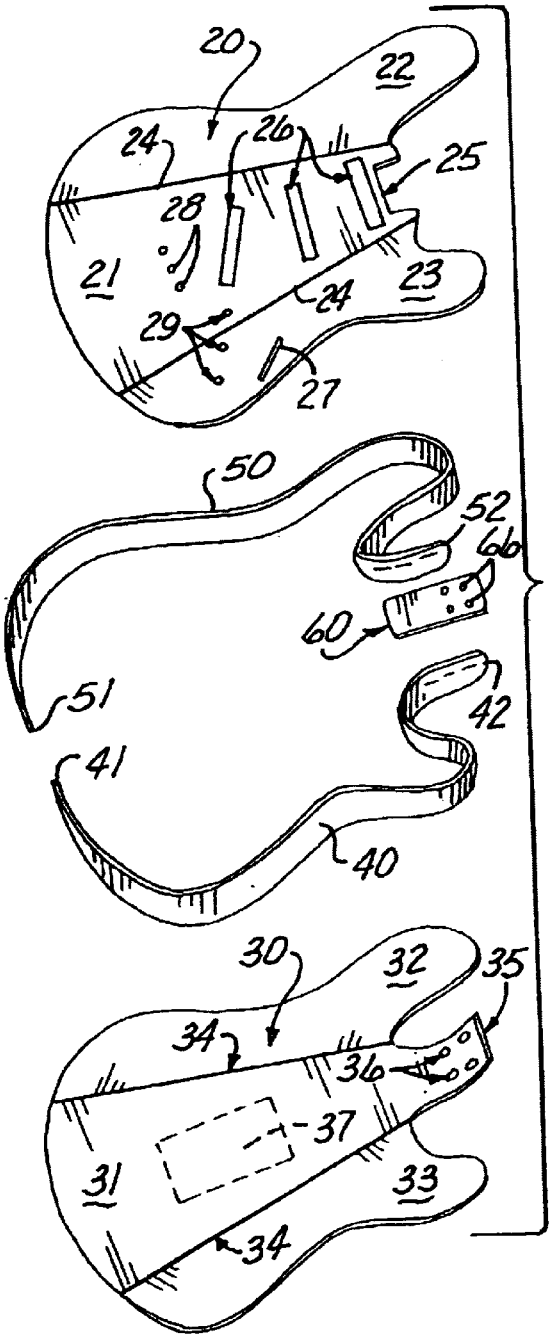
FIG. 4 is an exploded perspective view of the electric guitar soundboard structural components.
Figure 5:
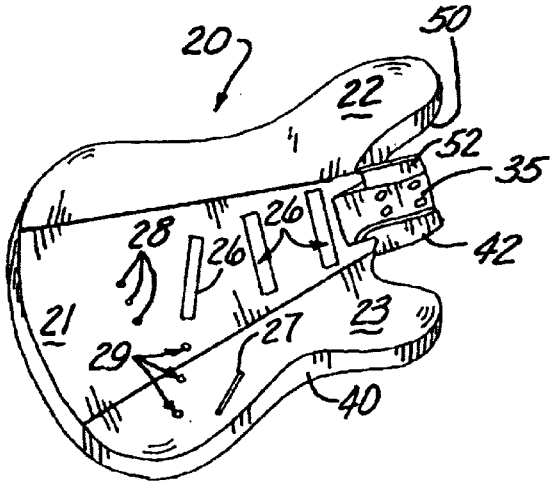
FIG. 5 is an assembled perspective view of the electric guitar soundboard.

As can be seen by reference to the drawings, and in particularly to FIGS. 1 and 4, the modular soundboard construction that forms the basis of the present invention is designated generally by the reference number 10. The construction 10 is fabricated from stamped aluminum magnesium structural components that consist of a soundboard panel 20, a floor panel 30, a pair of sidewall panels 40 and 50, and a neck mounting plate 60. These structural components will now be described in seriatim fashion.

In the electric guitar version of the preferred embodiment depicted in FIGS. 1 through 4, both the soundboard panel 20 and the floor panel 30 have a generally flat, raised central portion 21 31 flanked by angled wing portions 22 23 and 32 33 respectively wherein the transition between the flat central portions 21 31 and the angled wing portions 22 23 and 32 33 are defined by pairs of diverging crease lines 24 24 and 34 34.

As can best be appreciated by reference to FIG. 4, while the soundboard panel 20 and the floor panel 30 share the same general contours, the floor panel 30 is further provided with an outwardly projecting curved neck portion 35 having a plurality of mounting apertures 36 and an optional covered access opening 37 whereas the soundboard panel 20 is provided with a neck recess 25, a plurality of electric pickup ports 26, a pickup selector toggle switch slot 27, a plurality of bridge attachment holes 28, and a plurality of tone and pot mounting holes 29.

Still referring to FIG. 4, it can be seen that each of the sidewall panels 40 and 50 have a generally slender, tortuous contour and form the operative connection between the soundboard panel 20 and the floor panel 50 wherein, the proximal ends 41 51 of the sidewall panels 40 and 50 are joined together by welding and the distal ends 42 52 of the sidewall panels 40 50 are spaced from one another and welded to the opposite sides of the curved neck portion 35 of the floor panel 30 for reasons that will be explained presently.

Turning now to FIGS. 1, 2, 4, and 5, it can be seen that the guitar neck 200 is contoured to be received between the curved neck portion 35 of the floor panel 30 and the neck mounting plate 60 that is further provided with a plurality of mounting apertures 66 that align with the mounting apertures 36 of the curved neck portion 35 of the floor panel 30 wherein, conventional fasteners (not shown)are used to connect the guitar neck 200 to the finished modular soundboard 10 in a well recognized fashion.

Figure 6:
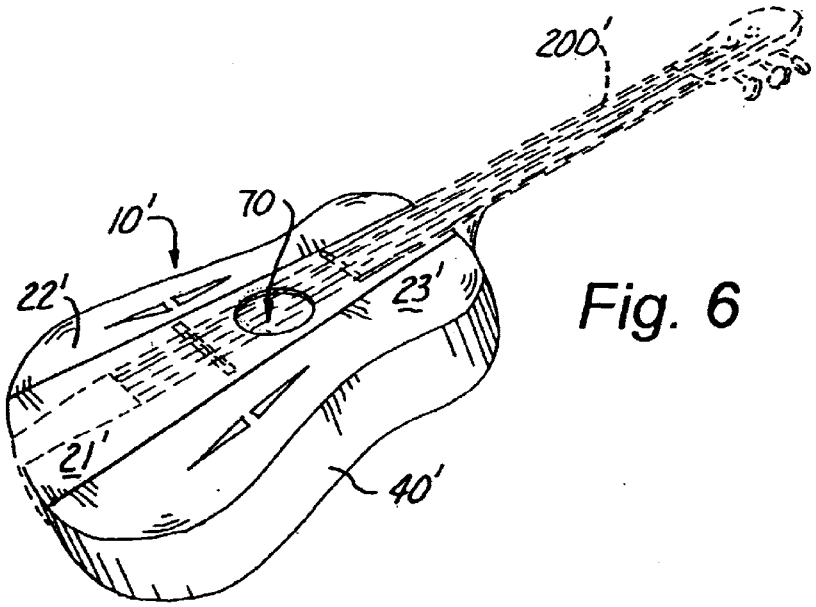
FIG. 6 is an assembled perspective view of an acoustic guitar soundboard; and, FIG. 7 is an exploded perspective view of the acoustic guitar soundboard structural components.
Figure 7:
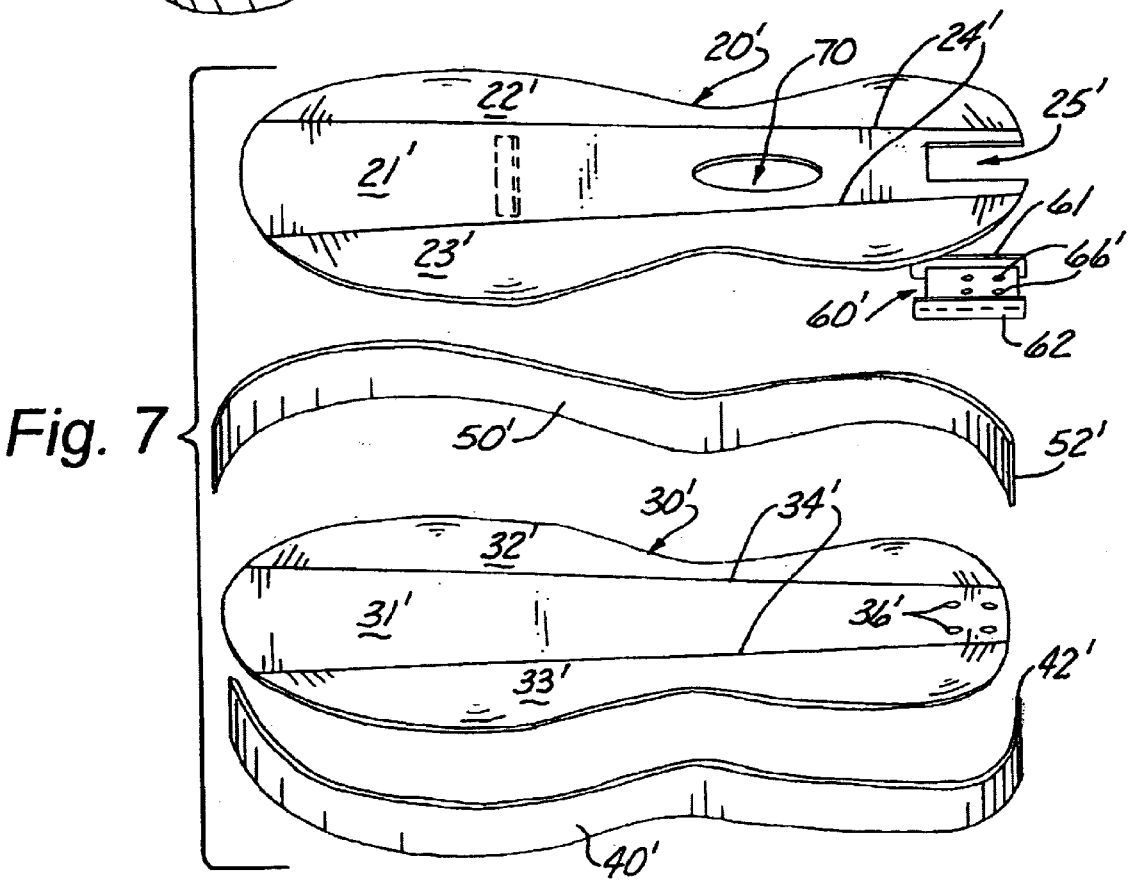

In the acoustic guitar version of the preferred embodiment depicted in FIGS. 6 and 7, it can be seen that the acoustic guitar soundboard construction 10' is similar in many respects to the electric guitar soundboard construction. The main differences being that the flat central portion 21' of the soundboard panel 20' is only provided with an enlarged sound hole 70 and the neck recess 25' whereas, the flat central portion 31' of the floor panel 30' is missing the curved neck portion and instead has the mounting apertures 36' formed on the distal end of the flat central portions 31'.

It should further be noted that in this version, the sidewall panels 40' and 50' are mirror images of one another, and the neck mounting panel 60' is further provided with a pair of vertical flanges 61 62 that are welded to the spaced distal ends 42' 52' of the side panels 40' 50' and the underside of the soundboard panel 20' wherein, the mounting apertures 66' of the neck mounting panel 60' are aligned with the mounting apertures 36' in the floor panel 30' for captively engaging the guitar neck 200' to the finished soundboard construction 10'.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A modular soundboard construction for stringed instruments wherein, the sound board construction comprises a soundboard panel fabricated from aluminum magnesium a floor panel fabricated from an aluminum magnesium and, a pair of sidewall panels fabricated from aluminum magnesium wherein, the sidewall panels are welded to the soundboard panel and the floor panel;

wherein, both the soundboard panel and the floor panel have a flat central portion and a pair of angled wing portions on opposite sides of the central portion wherein, the transition between the central portion and each wing portion is a straight crease.

2. The construction as in claim 1 wherein, the straight crease on each side of said central portion is angled relative to one another.

3. The construction as in claim 2 further comprising a neck mounting plate fabricated from aluminum magnesium and provided with a plurality of mounting apertures.

4. The construction as in claim 3 wherein, the soundboard panel has a proximal end and a distal end wherein, said distal end is provided with a neck recess.

5. The construction as in claim 4 wherein, the sidewall panels have proximal ends that are welded to one another and distal ends that are spaced from one another.

6. The construction as in claim 5 wherein, the sidewall panels are mirror images of one another.

7. The construction as in claim 5 wherein, the sidewall panels have different contours from one another.

8. The construction as in claim 5 wherein, the flat central portion of the soundboard panel is provided with an enlarged sound hole.

9. The construction as in claim 7 wherein, the flat central portion of the soundboard panel is provided with a plurality of electric pickup ports.

10. The construction as in claim 9 wherein, the soundboard panel is further provided with a toggle switch slot.

11. The construction as in claim 10 wherein, the soundboard panel is further provided with a plurality of bridge attachment holes.

12. The construction as in claim 11 wherein, the soundboard panel is further provided with a plurality of tone and pot mounting holes.

13. The construction as in claim 5 wherein, the floor panel is provided with a plurality of mounting apertures that are alignable with the mounting apertures in said neck mounting plate.

14. The construction as in claim 13 wherein, the floor panel has a proximal end and a distal end wherein said distal end is provided with a curved neck portion.

15. The construction as in claim 14 wherein, said curved neck portion is provided with said plurality of mounting apertures in the floor panel.

16. The construction as in claim 13 wherein, the neck mounting plate is further provided with a pair of vertical flanges.

* * * * *